US007286092B2

(12) United States Patent
Trejtnar et al.

(10) Patent No.: US 7,286,092 B2
(45) Date of Patent: Oct. 23, 2007

(54) RADIOCOMMUNICATIONS ANTENNA WITH MISALIGNMENT OF RADIATION LOBE BY VARIABLE PHASE SHIFTER

(75) Inventors: Zdenek Trejtnar, Weston Favell (GB); Thierry Gartner, Ciran (FR); Anthony Pallone, Civray en Touraine (FR); Arnaud Desneux, Chanceaux sur Choisille (FR)

(73) Assignees: Jaybeam Limited, Northamptonshire (GB); Mat Equipment, Amboise (FR)

( * ) Notice: Subject to any disclaimer, the term of this patent is extended or adjusted under 35 U.S.C. 154(b) by 0 days.

(21) Appl. No.: 10/496,154

(22) PCT Filed: Feb. 23, 2004

(86) PCT No.: PCT/FR2004/050074

§ 371 (c)(1),
(2), (4) Date: Nov. 8, 2005

(87) PCT Pub. No.: WO2004/077611

PCT Pub. Date: Sep. 10, 2004

(65) Prior Publication Data

US 2006/0066494 A1 Mar. 30, 2006

(30) Foreign Application Priority Data

Feb. 24, 2003 (FR) ..... 03 02237

(51) Int. Cl.
*H01Q 3/00* (2006.01)

(52) U.S. Cl. ..... 343/757; 343/702

(58) Field of Classification Search ..... 343/700 MS, 343/757, 702

See application file for complete search history.

(56) References Cited

U.S. PATENT DOCUMENTS

| | | | | |
|---|---|---|---|---|
| 2,119,607 | A * | 6/1938 | Sterba | 342/439 |
| 5,512,914 | A * | 4/1996 | Hadzoglou et al. | 343/816 |
| 5,917,455 | A * | 6/1999 | Huynh et al. | 343/792.5 |
| 6,310,585 | B1 * | 10/2001 | Marino | 343/818 |
| 6,545,643 | B1 * | 4/2003 | Sward et al. | 343/702 |
| 6,567,051 | B2 * | 5/2003 | Heinz et al. | 343/757 |
| 6,590,546 | B2 * | 7/2003 | Heinz et al. | 343/853 |
| 7,031,751 | B2 * | 4/2006 | Hurler et al. | 455/557 |
| 2003/0048230 | A1 * | 3/2003 | Heinz et al. | 343/757 |
| 2004/0155828 | A1 * | 8/2004 | Heinz et al. | 343/757 |
| 2006/0170592 | A1 * | 8/2006 | Heinz et al. | 342/359 |

* cited by examiner

*Primary Examiner*—Trinh Dinh
*Assistant Examiner*—Tung X Le
(74) *Attorney, Agent, or Firm*—Young & Thompson

(57) ABSTRACT

A radiocommunications antenna, notably for cellular radiotelephony network base station, of radiation lobe depointing type induced by variable phase adjustment unit including an actuating device including an actuator (13 or 41) whereof the displacement controls the phase shift, characterised in that it includes a module, insertable into the antenna and extractible therefrom, including a mechanical or electromechanical device co-operating with the actuating device to control the displacement of the actuator (13 or 41) when the module is installed in the antenna.

14 Claims, 10 Drawing Sheets

Figure 1:
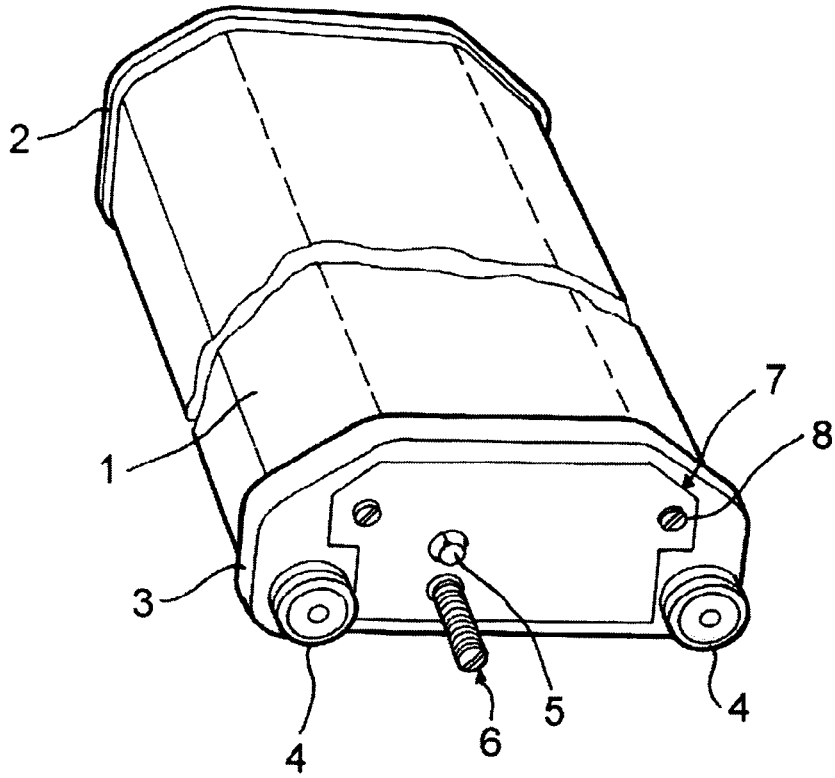

RADIOCOMMUNICATIONS ANTENNA WITH MISALIGNMENT OF RADIATION LOBE BY VARIABLE PHASE SHIFTER

The invention relates to a radiocommunications antenna for cellular radiotelephony network base station, and more particularly an antenna with radiation lobe depointing induced by variable phase adjustment unit.

By <<tilt>> is meant the angle made in the vertical plane, the direction of the maximum radiation pattern of the antenna with respect to the horizontal. This angle corresponds to a depointing of the radiation lobe, generally induced downwards.

The <<tilt>> is so-called <<mechanical>> when the antenna is installed with a tilt relative to the vertical. The <<tilt>> is so-called <<electric>> when the internal structure of the antenna sets forth electric phase shifting between the signals feeding the different elementary sources inside the antenna, combined to obtain the radiation requested in the vertical plane.

The electric <<tilt>> had been until a recent period a fixed parameter of the antenna. However, a new generation of antennas exists now which offers the possibility of modifying the electric <<tilt>> of an antenna to provide the cellular network operators with an additional parameter for cell adjustment and optimisation.

The variation in the electric <<tilt>> angle consists in arranging inside the antenna one or several variable phasing units. The current state of the art is such that the variation in the phase shift is obtained by mechanic displacement of parts having an electric function. The usual arrangements of these variable phasing units enable to drive them all together by means of a single actuator.

In these variable electric <<tilt>> antennas, two versions are available:

the antennas whereof the variation of the <<tilt>> is manual, by a control situated on the antenna properly speaking (so-called VET antennas). Generally, the control member is placed at the bottom of the antenna and consists either in a rod to be moved, or in an element to be rotated.

the antennas whereof the variation of the <<tilt>> may be operated remotely, by a remote control and a communication link between the control unit and the antenna properly speaking (so-called RET antennas). At the antenna an electric engine drives the control member and a sensor informs the control unit on the position (for instance) of the control member to manage the <<tilt>> imposed on the antenna.

The manufacturers see to it generally that their manual control antennas (VET) may be transformed into a remotely operatable version (RET) by adding an optional external box comprising among other things the engine and the sensor, which engages on the manual control.

The object of the invention consists in realising a variable electric <<tilt>> antenna by making extractible a module totally integrated into the antenna to transform a VET antenna into an RET antenna and vice versa. This module will correspond either to manual control for a VET antenna or to motorised control remotely operatable for an RET antenna.

The advantages of such modularity relative to the adjunction of an external box are:

No excrescence>> at the base of an antenna transformed into an RET version, thanks to this module which integrates into the antenna. This avoids the 'wart' aspect given by an external box to the base, and eliminates the brittleness of the antenna assembly fitted with this box during the installation on the site.

the sensor necessary to the remote control may be connected directly to the internal actuator of the variable phasing units in the antenna, since this module penetrates the antenna, instead of being connected thereto via the manual control member already present on the antenna. This dispenses with pre-positioning the antenna as well as the external box on the same <<tilt>> value before assembling them to one another. The operation is simpler and does not exhibit any error sources any longer. It may even be contemplated on site, i.e. without dissembling the antenna of its installation.

the module in RET version inserted at the antenna may itself always have a manual control available, whereas an external box which engages on the existing manual control thereby masks access to this control.

The invention relates therefore generally to a variable electric <<tilt>> antenna whereof the transformation between a manual control version and a remote control version (or vice versa) operates by extraction of an internal module at the antenna and replacement with another providing the new functionality required.

It relates more precisely to a radiocommunications antenna, notably for cellular radiotelephony network base station, of radiation lobe depointing type induced by variable phase adjustment unit comprising an actuating device including an actuator whereof the displacement controls the phase shift. The antenna according to the invention includes a module, insertable into the antenna and extractible therefrom, including a mechanical or electromechanical device co-operating with the actuating device to control the displacement of the actuator when the module is installed in the antenna.

In a first embodiment, the mechanical or electromechanical device comprises a mobile actuating block, either of an engine type, in particular for remote actuation, of manual actuation type, and the actuating device comprises a means removably connectable to the actuating block.

Besides, in this embodiment, the means removably connectable to the mobile actuating block comprises a square having a first portion and a second portion, the first portion being permanently interconnected with the actuating block and the second portion being removably connectable to the actuator.

In a second embodiment, the actuating device comprises:

- a control pin, comprising a screw and a shaft comprising grooves, said control pin being terminated at the end of said screw by a recess,
- a block, interconnected with a fixed portion of the antenna and comprising a tapered orifice forming a bearing, and
- a mobile stop, interconnected with said actuator, said mobile stop comprising a notch intended for receiving said recess of said control pin, so that a rotation of said screw, and thereby of the control pin, in said bearing induces the displacement of said actuator.

Besides, in this second embodiment

- the actuating device comprises a cylindrical part, comprising a first pinion gear and a through-bore, the wall of said bore comprising tabs, said cylindrical part being installed coaxially on the shaft of the control pin, and
- the electromechanical device of the module includes a second pinion gear, which can be actuated by means of an engine, engaging with the first gear when the module is installed in the antenna, so that the rotation of the control pin is induced by a rotation of the first gear, the tabs of the cylindrical part being engaged in the grooves of the driving shaft, in order to enable a coaxial translation movement between said cylindrical part and the control pin.

In this embodiment, the actuator is a plate, or several plates interconnected to one another, sliding inside a fixed portion of the antenna.

Figure 2:
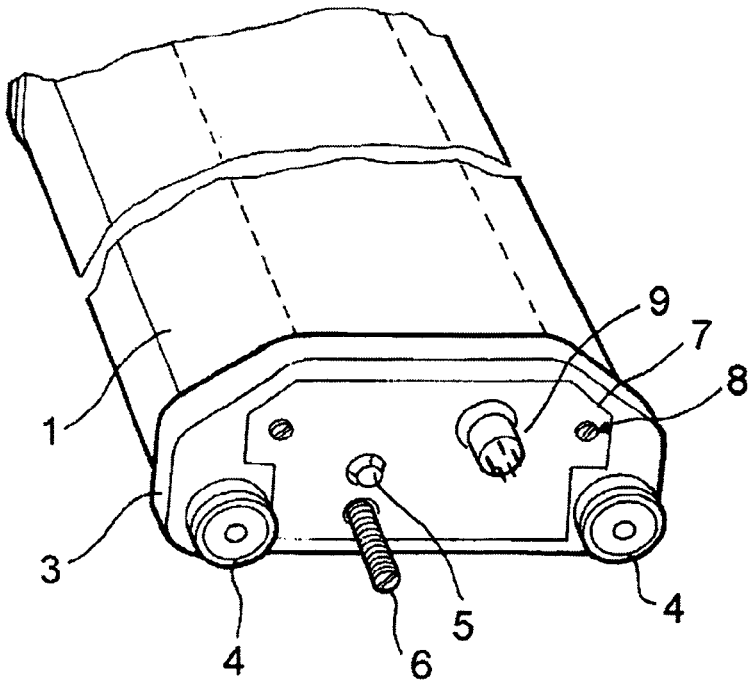
Figure 3:
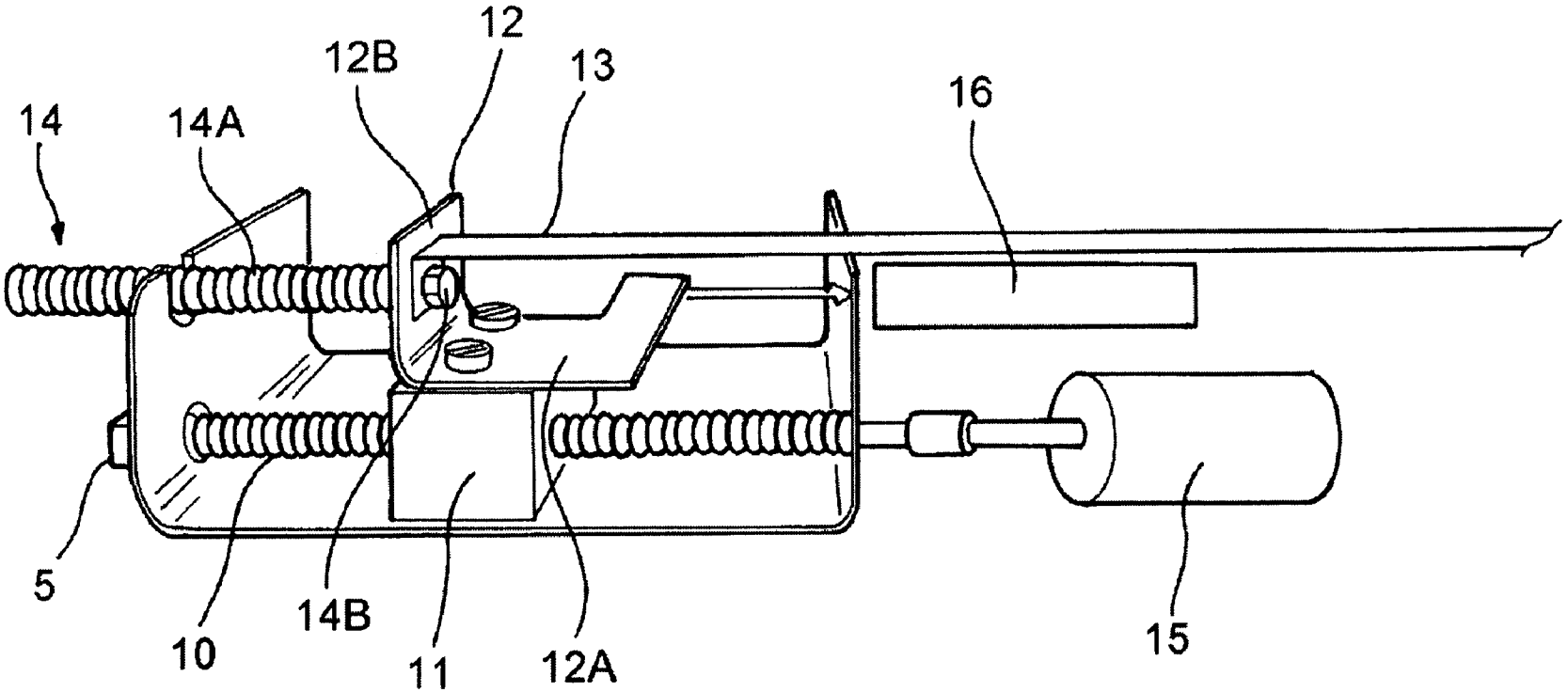
Figure 4:
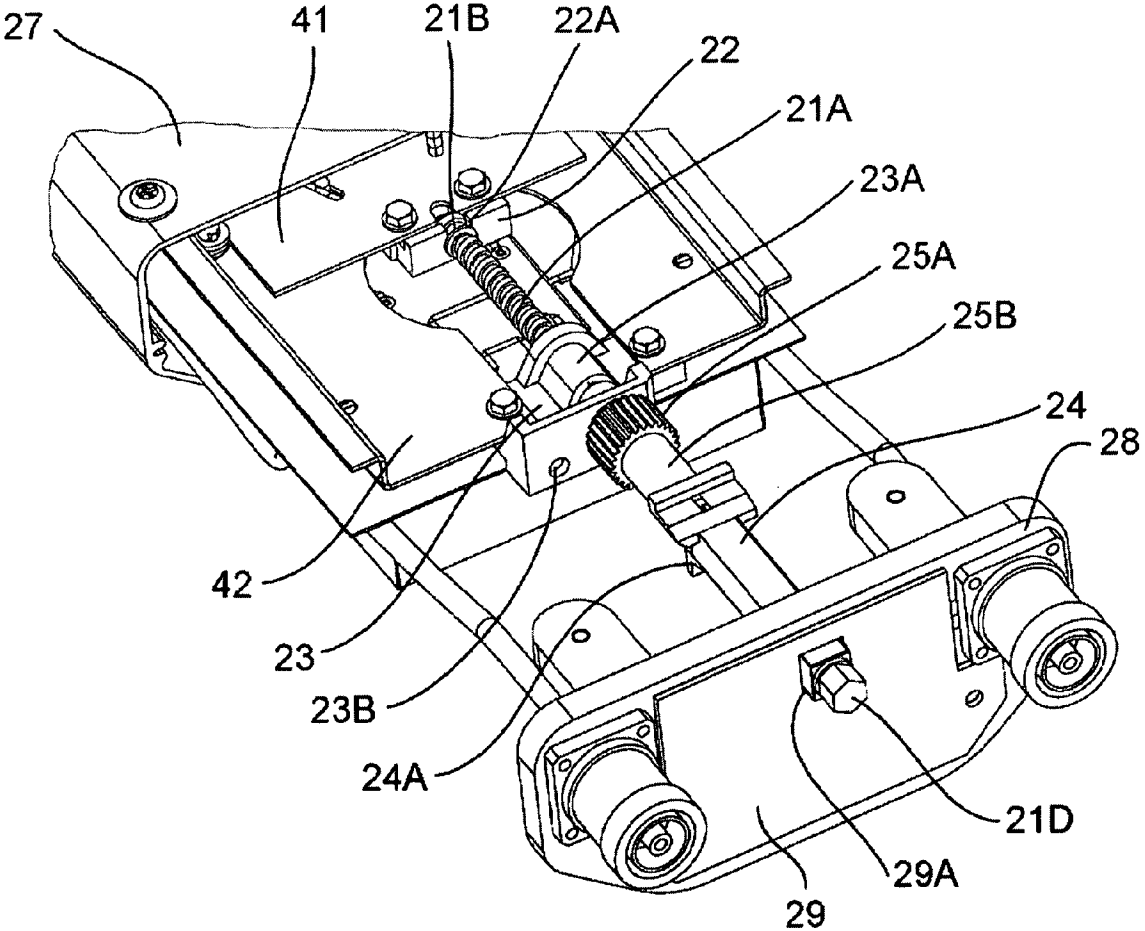
Figure 5:
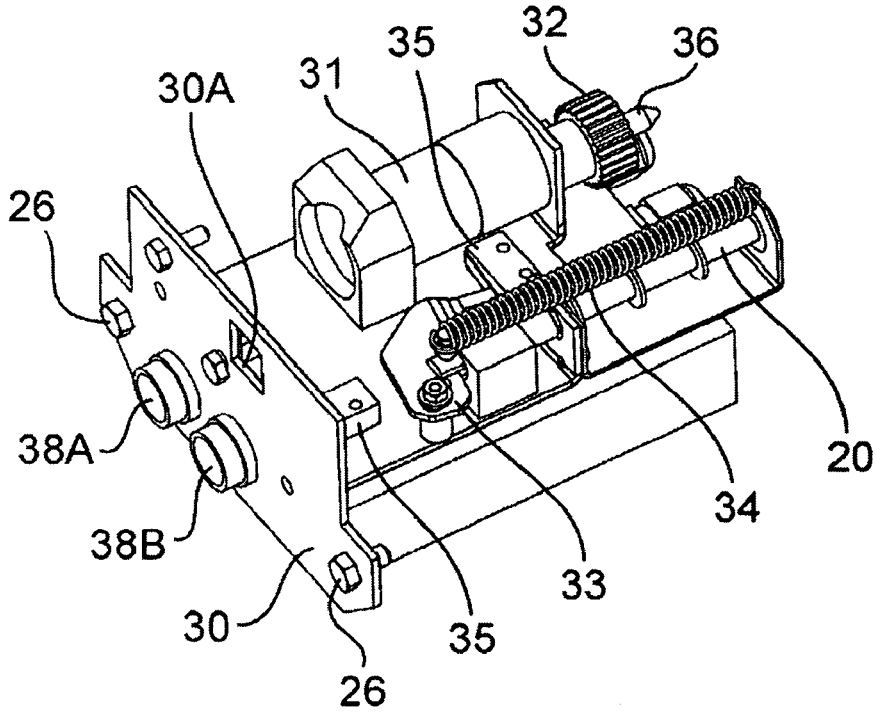
Figure 6:
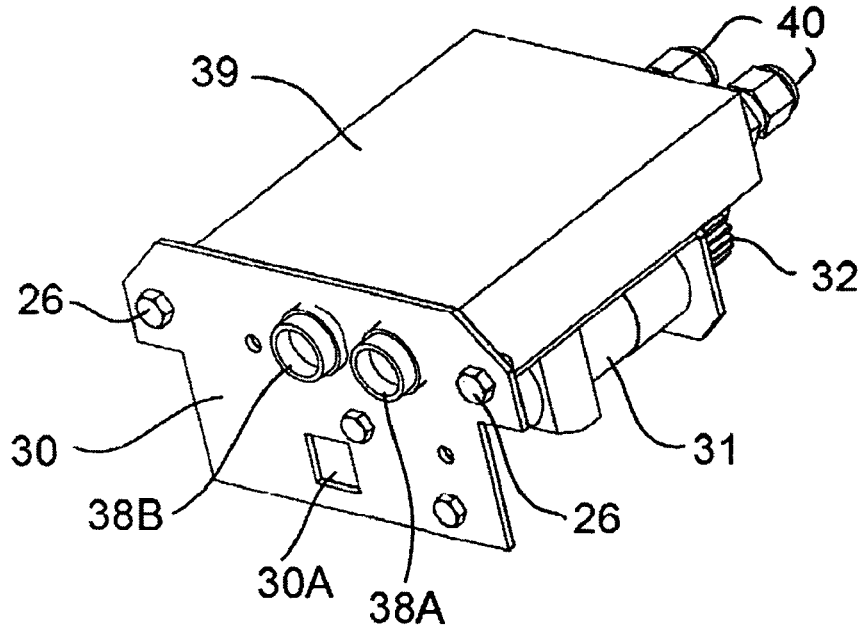

FIGS. 1, 2 and 3 relate to a first embodiment of the antenna according to the invention. They represent respectively:

FIG. 1: a perspective view of an antenna according to the invention in its manual control version;

FIG. 2: a perspective view of an antenna according to the invention in its remote control version;

FIG. 3: a perspective view of an extractible module of the antenna according to the invention in its remote control version;

FIGS. 4, 5, 6 and 7 relate to a second embodiment of the antenna according to the invention. They represent respectively:

FIG. 4: a perspective view of the lower portion of an antenna according to the invention in its manual control version;

FIG. 5: a perspective view of an extractible module of an antenna according to the invention in its remote control version;

FIG. 6: a view from a different angle of the module of FIG. 5.

Figure 7:
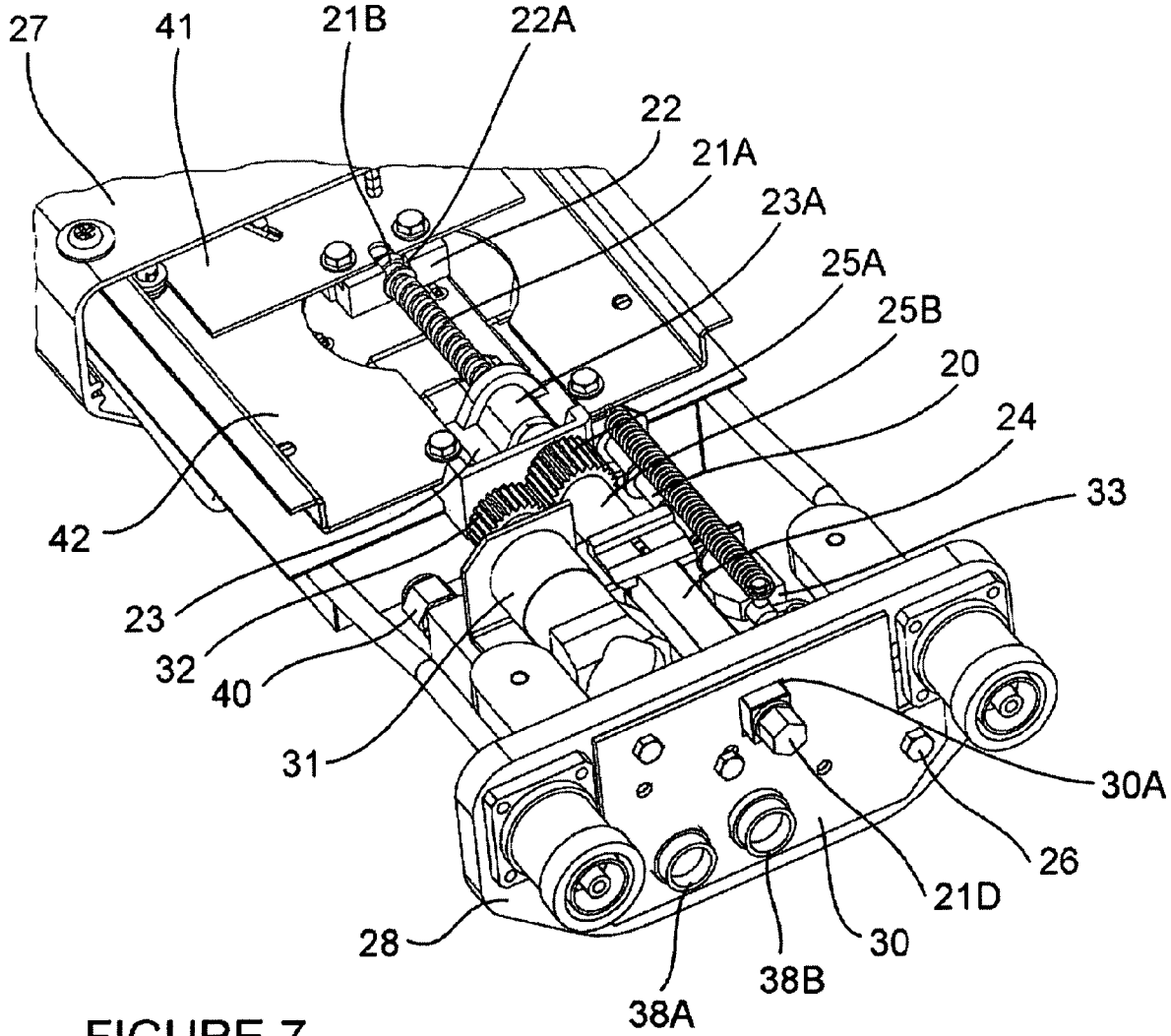
Figure 8B:
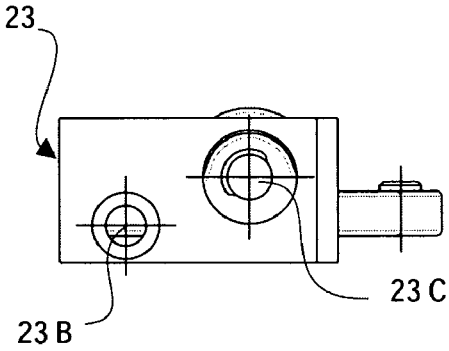
Figure 8A:
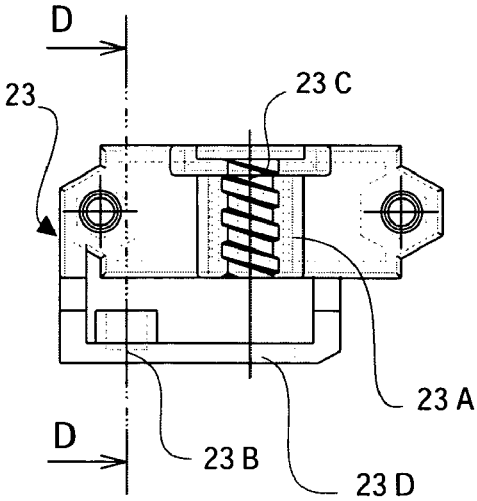

FIG. 7: a perspective view of the lower portion of an antenna according to the invention in its remote control version;

FIGS. 8A, 8B, 8C and 8D relate to a block integrated to the antenna according to the second embodiment. They represent respectively:

FIG. 8A: a front view of the block

FIG. 8B a view from beneath of the block

Figure 8C:
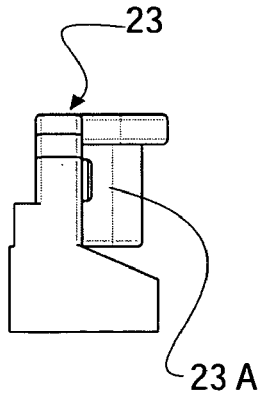

FIG. 8C a left-hand side view of the block

Figure 8D:
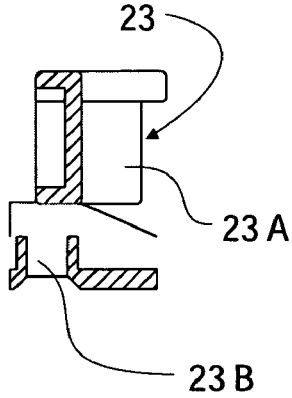

FIG. 8D: a sectional view of the block on the plane D-D defined in FIG. 8A.

Figures 9A, 9B:
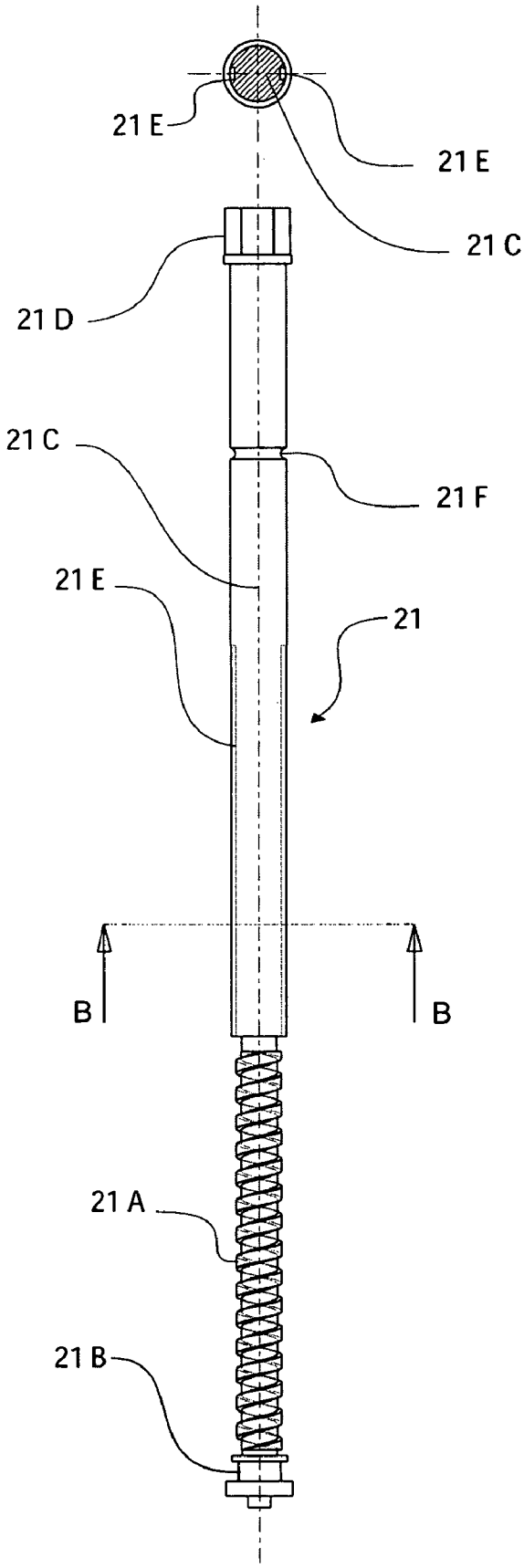

FIGS. 9A and 9B relate to a control pin integrated to the antenna according to the second embodiment. They represent respectively:

FIG. 9A: a longitudinal view of the control pin;

FIG. 9B: a sectional view of the control pin in the plan B-B defined in FIG. 9A.

Figure 10B:
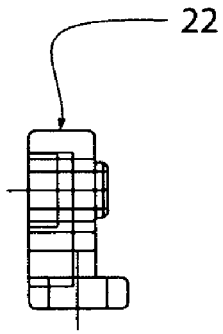
Figure 10A:
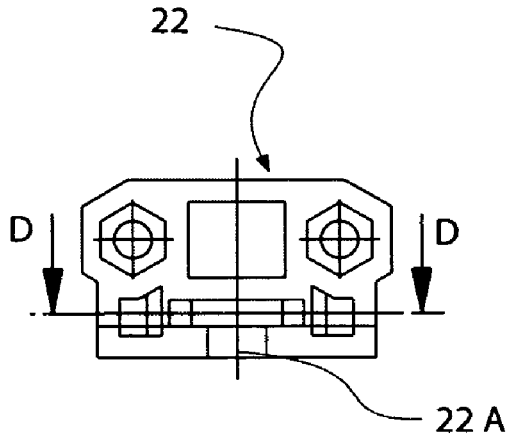

FIGS. 10A, 10B, 10C and 10D relate to a mobile stop integrated to the antenna according to the second embodiment. They represent respectively:

FIG. 10A: a front view of the mobile stop

Figure 10D:
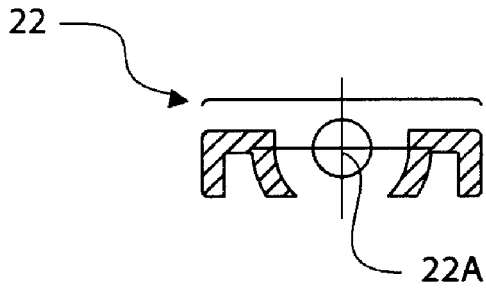
Figure 10C:
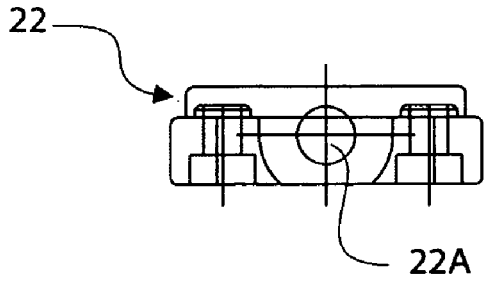

FIG. 10B: a right-hand side view of the mobile stop;

FIG. 10C: a top view of the mobile stop;

FIG. 10D: a sectional view of the mobile stop in the plan D-D defined in FIG. 10A.

Figure 11C:
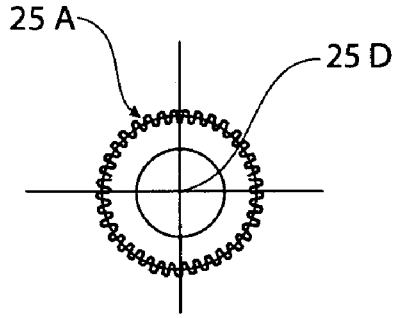
Figure 11A:
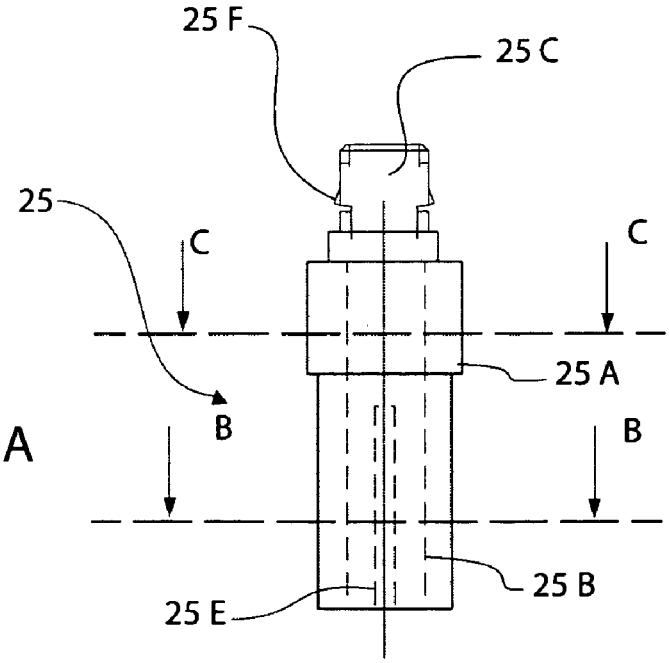
Figure 11B:
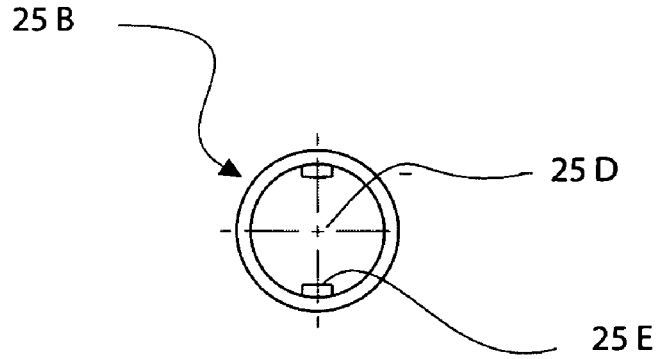

FIGS. 11A, 11B, 11C, relate to a cylindrical part integrated to the antenna according to the second embodiment. They represent respectively:

FIG. 11A: a front view of the cylindrical part

Figure 12A:
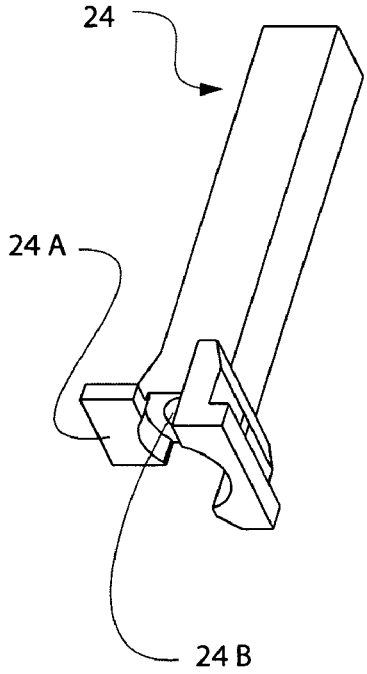
Figure 12B:
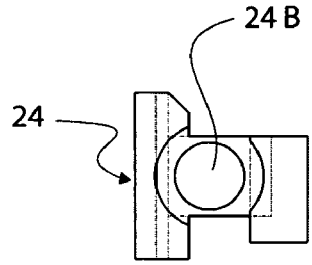

FIG. 11B: a sectional view of the cylindrical part in the plan B-B defined in FIG. 11A;

FIG. 11C: a sectional view of the cylindrical part in the plan C-C defined in FIG. 11A;

FIGS. 12A and 12B relate to a sleeve integrated to the antenna according to the second embodiment. They represent respectively:

FIG. 12A: a perspective view of the sleeve;

FIG. 12B: an end view of the sleeve.

FIG. 1 represents an example of antenna used in the cellular network base stations. Such an antenna is installed vertically (carried by a supporting structure such as pylon, directly by a wall, etc.).

The antenna is composed of an envelope 1, called radome or cover, closed at its ends by an upper cap 2 and by a lower cap 3. This lower cap 3 includes one or several coaxial connectors forming access to the antenna for radio signals. Other embodiments or arrangements are possible.

A variable electric <<tilt>> antenna differs from a fixed <<tilt>> antenna by the presence of the variation control member of the electric (<tilt>>. FIG. 1 thereby represents an antenna whereof the electric <<tilt>> is modifiable manually, using the members for adjusting and locating the electric <<tilt>> situated at its base, which is the most conventional arrangement.

On FIG. 1, the part 5 of hexagonal shape enables by rotation to modify the electric <<tilt>> of the antenna. A sleeve 6 forms the locating member; it is moved inside of the antenna directly by the actuator 13 (FIG. 3) of the variable phase adjustment unit, and it comes more or less out of the antenna when the part 5 revolves around its axis. This sleeve 6 includes graduation lines which enable to locate the <<tilt>> angle value adjusted for the antenna as the part 5 rotates in one direction or in the other. Other arrangements or other shapes of the adjusting member and of the locating member are possible without departing from the modularity principle described below.

Two screws 8 immobilise the plate 7 on the part 3 interconnected with the antenna. The plate 7 supports, inside the antenna, a module transforming the action on the part 5 into a motion of the actuator 13 of the variable phasing units.

This module may be extracted from the antenna by removing screw 8 and by disconnecting it from the actuator 13 of the variable phase adjustment unit by unscrewing the sleeve 6 as described below. A recess in the part 3 lets through this module outwardly, said recess being closed by the plate 7 when everything is installed.

The same RET version antenna controllable remotely is represented by FIG. 2. The difference lies in the presence of a connector 9 enabling to supply the energy necessary to the rotation of the engine and enabling to exchange the control signals from a remote unit. These signals may respond to any protocol or specification without departing from the principle exposed. If an electronic circuit is necessary to convert or interpret the signals exchanged, these circuits will also be attached and/or integrated to the extractible module held by the plate 7.

FIG. 3 shows an embodiment of the extractible module. On this figure, the plate 7 is not installed.

The engine 15, the position sensor 16 and the members which connect it to the remainder of the mechanical system are only present in an RET module.

As represented on FIG. 3, the module includes an actuating block comprising a screw 10 and a part 11 displaceable on the screw 10. A square 12 links the part 11 to the actuator 13.

A rotation of the part 5 or of the engine 15 rotates the screw 10 which moves linearly the part 11 and the square 12 attached to the part 11. This displacement is here linear since, in this embodiment of the antenna, the design of the variable phase adjustment unit is based on a linear movement in order to vary said units.

The actuator 13 of these variable phase adjustment unit is a rod which carries in its end a screw 14, comprising a screw head 14B and a screw body 14A, which itself runs through the square 12.

The square 12 comprises a first portion 12A and a second portion 12B, the first portion 12A being permanently interconnected with the actuating block (10,11) and the second portion 12B being removably connectable to the actuator 13.

The nut which immobilises the assembly 13 and 14 on the square 12 is the tapered sleeve 6 described above. Thanks to this tapered sleeve 6 screwed on the screw body 14A of the screw 14 until said sleeve 6 abuts against the second portion 12B of the square 12, the actuator 13 of the variable phase adjustment unit is well interconnected with the movement of the members 11 and 12.

Indeed, when the sleeve 6 is screwed completely on the screw 14 in order to cover entirely the screw body 14A, the actuator 13 and the second portion 12B of the square 12 are tightened between the screw head 14B of the screw 14 and the sleeve 6, thereby interconnecting the actuating device.

There resides the possibility of making the module extractible and exchangeable with another: accessibility from the outside (through the sleeve 6) for disconnection between the actuating mechanical parts (10, 11,12) and the actuator 13.

When the sleeve 6 is unscrewed totally, the screw 14 is long enough to protrude from the plate 7.

This enables to engage the sleeve 6 easily on the screw 14 in order to screw this sleeve 6 and interconnect the whole actuating mechanical section.

This also enables that, by extracting the VET or RET module, this screw 14 remains engaged in the member 12 until the member 12 is visible. Similarly, when another module is installed, it is possible to engage the screw 14 in the hole provided to this end in the member 12 before the member 12 is inside the antenna, therefore not visible which would make this engagement tricky, let alone impossible.

Once the new module inserted totally, and after immobilisation by the screw 8, the sleeve 6 is screwed on the screw 14 making again the mechanical assembly interconnected and functional.

The reference 16 is a position sensor of the RET module.

In another embodiment, represented on FIG. 4 at 7, the antenna comprises a nut for the transformation of a rotational movement into a translation movement of the actuator of the variable phase adjustment unit which remains interconnected with said actuator, during the extraction of the control module of the antenna. Similarly to the first embodiment, the engine as well as the position sensor are completely integrated to the module in its remote control version.

The difference between both embodiments lies, among other things, in the screw-nut system, associated with the module in the first embodiment and associated with the antenna in the second embodiment.

This embodiment dispenses advantageously with a screw-nut assembly simultaneously in the extractible manual control module and the extractible remote control module, the manual control module requiring neither engine, nor position sensor nor remote means of communications.

The manual control module is then composed only of a single plate 29 thereby limiting to the maximum the number of parts necessary.

Thus, to transform of the antenna from manual control version to remote control version, it suffices to remove the plate 29 attached to the lower cap 28 and to insert, inside the antenna, a module as represented on FIGS. 5 and 6.

FIG. 4 represents the lower portion of a variable electric <<tilt>> antenna in its manual control version.

The extractible module of the antenna is solely composed of a single plate 29.

The screw-nut assembly, formed of a screw 21A and a bearing 23A, remains interconnected with the antenna, during the retraction of the extractible module from the antenna.

The bearing 23A is part of a block 23, represented in detail on FIGS. 8A at 8D, said block 23 being interconnected with a fixed portion 42 of the antenna. This block 23 includes a first orifice 23B, a second tapered orifice 23C, forming the bearing 23A mentioned above, and a third orifice 23D, the orifices 23C and 23D being coaxial.

The screw 21A is part of a control pin 21, represented in detail on FIGS. 9A and 9B. The control pin 21 is terminated at the end of the screw 21A by a recess 21B.

At the other end of the screw 21A and in the extension thereof, the control pin 21 also comprises a non threaded portion, forming a shaft 21C, terminated, in the end of the control pin 21, by a hexagonal part 21D.

The shaft 21C includes grooves 21E and a circumferential groove 21F.

The actuator 41 of the variable phase adjustment unit is composed of a sliding plate inside a fixed portion 42 of the antenna. The actuator 41 may also be composed of several plates interconnected to one another.

A mobile stop 22, represented in detail on FIGS. 10A to 10D, interconnected with the actuator 41, includes a notch 22A.

The notch 22A of the mobile stop 22 is intended for receiving the recess 21B of the control pin 21, in order to realise a pivot link between the mobile stop 22 and the control pin 21.

As can also be seen on FIG. 4, the control pin 21 is extended up to the outside of the antenna by going through an aperture 29A provided in the plate 29 and is terminated by a hexagonal part 21B, said hexagonal part 21B which should be accessible to an operator with a view to a manual control of the <<tilt>> angle.

A cylindrical part 25, represented in detail on FIGS. 11A at 11C, includes a gear 25A, a body 25B, a head 25C and a bore 25D running through completely said cylindrical part 25.

The head 25C includes toes 25F.

This cylindrical part 25 is attached by means of a pivot link to the block 23, the head 25C of the cylindrical part 25 inserted in the orifice 23D of the block 23. The cylindrical part 25 is locked in translation in the part 23 by latching the toes 25F situated on the circumferential surface of the head 25C.

Thus, the cylindrical part 25 may move in rotation inside the part 23 through the orifice 23D.

The wall of the bore 25D includes tabs 25E along the body 25B of the cylindrical part 25.

This cylindrical part 25 is installed coaxially on the shaft 21C of the control pin 21, the tabs 25E of the cylindrical part 25 being engaged in the grooves 21E of the driving shaft 21, in order to enable a coaxial translation movement between said cylindrical part 25 and the control pin 21.

The function of the gear 25A will be described below in combination with a removable module for the remote control.

A sleeve 24, represented in detail on FIGS. 12A and 12B, includes a finger 24A whereof the function will be specified below.

The sleeve 24 is installed, by means of a pivot link on the shaft 21C of the control pin and protrudes outside the module through the aperture 29A provided in the plate 29.

A bore 24B, made in the sleeve 24, is intended for receiving coaxially a portion of the shaft 21C of the control pin 21.

The attachment of the sleeve 24 on the shaft 21C of the control pin 21 is made by latching the sleeve 24 by means of the circumferential groove 21F provided to that effect.

The sleeve 24, the gear 25 and the control pin 21 remain interconnected with the antenna, when dismantling the plate 29, and enable to replace this plate 29 with a remote control module enabling to drive the actuator 41 without needing to dismantle any other part of the antenna, said module will be described in combination with FIGS. 5 to 7.

FIG. 4 illustrates the structure of a variable electric <<tilt>> antenna in its manual control version.

The rotation of the hexagonal part 21D drives an identical rotation of the screw 21A, both these parts belonging to the control pin 21.

This rotation operates in the tapered orifice 23C of the bearing 23A wherein may rotate the screw 21D of the control pin 21 in order to induce a translation displacement of said control pin 21, said block 23 being attached to a fixed portion 42 of the antenna.

The control pin 21 moves therefore along a linear pattern, combined with a rotational movement, and is connected to the mobile actuator 41 of the variable phase adjustment unit by mean of the mobile stop 22 interconnected with said actuator 41.

During the displacement of the screw 21A through the bearing 23A, the sleeve 24 which includes graduations to specify the corresponding value of the electric <<tilt>>, protrudes more or less outside the plate 29 through the aperture 29A, provided in the plate 29, which enables an operator, thanks to the graduations, to know the value of the <<tilt>>.

On top of these graduations in angle value of the <<tilt>>, the sleeve 24 may advantageously include coloured zones with different colours between each graduation, enabling thereby to know, without reading, the value of the <<tilt>> whereto the antenna is set.

In this view, these coloured zone graduations facilitate rapid acquisition, without reading, of the <<tilt>> angle adjusted on the antenna for an operator from a distance greater than that which is necessary for reading graduation values carried by the sleeve 24.

FIG. 5 represents the module, extractible of an antenna in its remote control version, extracted from the antenna.

The module comprises parts which are totally interconnected with said module.

There can be seen more particularly a pinion gear 32, which can be actuated via an engine 31, the shaft of said gear 32 comprising a terminal portion 36.

The module also includes a position sensor 20, a driving cam 33, a recall spring 34, two limit switch micro-sensors 35 and a plate 30.

Preferably, the position sensor 20 is an absolute position sensor, so that the module does not require any calibration operations, when inserting the module in the antenna.

For instance, this position sensor 20, necessary to the remote control, may be directly associated with the position of the actuator 41 of the phase adjustment unit and not of the engine 31 properly speaking in order to supply an absolute indication independent of any possible problem of the engine 31.

Preferably, the position sensor 20 is a linear displacement sensor realised with contact free technology in order to increase its lifetime.

For instance, this sensor may be of LVTD type (linear variable differential transformer) wherein a metal core moves in the centre of three juxtaposed reels. The central reel is power supplied by an alternate voltage and the ratio of the voltages supplied by both end reels corresponds to the relative position of the core with respect to these reels.

The plate 30, whereof the shape is substantially identical to the plate 29, includes an aperture 30A provided in said plate 30, said aperture 30A being identical to the aperture 29A provided in the plate 29.

Two connectors 38A and 38B installed on the plate 30 enable to connect the module with an electric power supply and with a device forming the control signals of the electric <<tilt>>.

The connector 38A provides from a management unit (not represented) the supply voltage and the control signals of the electric tilt.

The other connector 38B enables to carry forward the voltage and the signals to a neighbouring antenna if the control protocol used allows operation by addressing units on a common network.

FIG. 6 represents a perspective view from another angle of the module of FIG. 5.

The box 39 of the module includes unit management electronic circuits which interprets the control signals received on the connector 38A relative to the communication protocol used, drives the engine 31 and reads the indication of the position sensor 20, monitors the operating state of the assembly and transmits state and alarm messages via the connector 38A or 38B according to the communication protocol used.

The parts 40 form the outputs of the wires towards the engine 31, the position sensor 20 and the limit switch micro-sensors 35.

As can be seen on FIGS. 4 and 7, the antenna is housed entirely in an envelope 27 closed at its lower end by a lower cap 28. This lower cap 28 includes a closed recess, either by the plate 29 in the manual control version (FIG. 4), or by the plate 30 in the remote control version (FIG. 7).

The module described above is insertable, as illustrated on FIG. 7, in the lower portion of the antenna after retraction of the plate 29.

The module in the lower portion of the antenna is immobilised by attaching the plate 30 on the lower cap 28 by dint of the screw 26.

The external space requirements of this module enable said module to be accommodated in the lower portion of the antenna through the recess of the lower cap 28, while enabling the extraction of said module at a later stage, for example, to replace it with the manual control module.

When inserting this module, several parts of said module engage into different parts interconnected with the antenna.

Indeed, the terminal portion 36 of the shaft of the pinion gear 32, which can be actuated by means of the engine 31, engages in a orifice 23B (visible on FIG. 4), realised in a block 23 interconnected with a fixed portion 42 of the antenna, the orifice 23B playing the role of a bearing.

Simultaneously, the pinion gear 32, which can be actuated by means of the engine 31 and interconnected with the module, is coupled with the pinion gear 25, interconnected with the antenna, according to a gear mechanism.

The orifice 23B provides parallelism of the axis of the pinion gear 32 with the axis of the pinion gear 25.

The rotation of the gear 32 by means of the engine 31 drives the rotation of the gear 25A of the cylindrical part 25 and consequently the rotation of the control pin 21.

The rotation of the screw 21A of the control pin 21 in the tapered orifice 23C of the part 23 is accompanied by a translation movement of the control pin 21, which slides inside the cylindrical part 25, guided by tabs 25E co-operating with the grooves 21E.

The translation of the control pin 21 is accompanied by the translation of the actuator 41.

The sleeve 24, which moves simultaneously with the actuator 41 of the variable phase adjustment unit, includes a finger 24A acting on the cam 33 driving the position sensor 20.

A spring 34 enables the cam 33 to rest permanently on the finger 24A.

The sleeve 24 is permanently visible outside the antenna, said sleeve 24 protruding outside the module by the aperture 30A provided in the plate 30, enabling to maintain the possibility of controlling visually the value of the electric <<tilt>> whereto the antenna is set.

Manual control of the displacement of the actuator 41 by dint of the hexagonal part 21D is always available in the remote control version of the module.

In such a case, the position sensor 20 is always driven and thereby supplies a indication corresponding to the actual value adjusted of the <<tilt>> on the antenna.

Both limit switch micro-sensors 35 form a safety in the control system of the engine 31 in case where mobile parts would abut against one of the ends of the useful travel.

These micro-sensors 35 are composed of switches, also called in such a case micro-switches. Other types of micro-sensors may however be used.

In both embodiments described above, the module according to the invention is extractible from the antenna through the lower portion of the antenna through the recess provided in the lower cap 3 or 28.

It also possible to provide other embodiments wherein the extraction of the module is performed through other apertures provided in the antenna, for instance in the lateral sides of the envelope 1 or 27 of said antenna or in the upper cap of the antenna.

The invention claimed is:

1. A radiocommunication antenna, comprising:

a variable phase adjustment unit that directs a radiation lobe of the antenna by variable phase adjustment and that includes an actuating device with an actuator (41) whose displacement controls the phase shift; and a module, insertable into the antenna and extractible therefrom, including a mechanical or electromechanical device co-operating with the actuating device to control the displacement of the actuator when the module is installed in the antenna, the actuating device having a control pin (21) comprising a screw (21A) and a shaft (21C) comprising grooves (21E), said control pin (21) being terminated at the end of said screw (21A) by a recess (21B), a block (23), interconnected with a fixed portion (42) of the antenna and comprising a tapered orifice (23C) forming a bearing (23A), and a mobile stop (22), interconnected with said actuator (41), said mobile stop (22) comprising a notch (22A) intended for receiving said recess (21B) of said control pin (21), so that a rotation of said screw (21A), and thereby of the control pin (21), in said bearing (23A) induces the displacement of said actuator (41).

2. An antenna according to claim 1 characterised in that:

the actuating device comprises a cylindrical part (25), comprising a first pinion gear (25A) and a through-bore (25D), the wall of said bore (25D) comprising tabs (25E), said cylindrical part (25) being installed coaxially on the shaft (21C) of the control pin (21), and the electromechanical device of the module includes a second pinion gear (32), which can be actuated by means of an engine (31), engaging with the first gear (25A) when the module is installed in the antenna, in order to induce the rotation of the control pin (21) by a rotation of the first gear (25A), the tabs (25E) of the cylindrical part (25) being engaged in the grooves (21E) of the driving shaft (21), in order to enable a coaxial translation movement between said cylindrical part (25) and the control pin (21).

3. An antenna according to claim 2 characterised in that it comprises a sleeve (24), comprising angle value graduations of the <<tilt>> and a bore (24B), installed coaxially by means of a pivot link on the shaft (21C) of the control pin (21) and protruding outside the module through an aperture (30A) provided in the plate (30), which moves simultaneously with the actuator (41) of the phase adjustment unit.

4. An antenna according to claim 1 characterised in that it comprises a sleeve (24) comprising angle value graduations of the <<tilt>> and a bore (24B), installed coaxially by means of a pivot link on the shaft (21C) of the control pin (21) and protruding outside the module through an aperture (30A) provided in the plate (30), which moves simultaneously with the actuator (41) of the phase adjustment unit.

5. An antenna according to claim 4 characterised in that said sleeve (24) includes coloured zone graduations, corresponding to a value of the tilt, enabling a rapid acquisition, without reading, of the angle value of the "tilt".

6. An antenna according to claim 1, characterised in that the actuator (41) is a plate, or several plates interconnected to one another, sliding inside a fixed portion (42) of the antenna.

7. An antenna according to claim 1, characterised in that the extractible module comprises a position sensor that determines the position of the actuator.

8. An antenna according to claim 7 characterised in that said position sensor is an absolute position sensor, so that the module does not require any calibration operations, when inserting the module in said antenna.

9. An antenna according to claim 8 characterised in that the sleeve (24) includes a finger (24A) acting on a cam (33) actuating said position sensor (20), said cam (33) and said position sensor (20) being interconnected with said extractible module.

10. An antenna according to claim 7 characterised in that the sleeve (24) includes a finger (24A) acting on a cam (33) actuating said position sensor (20), said cam (33) and said position sensor (20) being interconnected with said extractible module.

11. An antenna according to claim 10 characterised in that a spring (34) enables to maintain the cam (33) to rest permanently on the finger (24A), said spring (34) being interconnected with said extractible module.

12. A radiocommunications antenna, comprising:

a variable phase adjustment unit that directs a radiation lobe of the antenna by variable phase adjustment and that includes an actuating device with an actuator whose displacement controls the phase shift;

an antenna cover having one end closed by an external cap, the variable phase adjustment unit being accessible at the one end of said antenna cover closed by said external cap, said external cap having an opening that exposes an inside of said external cap; and a module removably inserted inside said opening of said external cap and including at least one of a mechanical and electromechanical device, co-operating with the actuating device to control the displacement of the actuator, said module having a plate that closes said opening and external means for removably attaching said plate to said external cap.

13. The antenna of claim 12, further comprising a visual indicator that extends outside said plate by a variable distance that corresponds to the displacement of said actuator.

14. The antenna of claim 12, further comprising a rotatable element that is on an external surface of said plate and that is attached to displace said actuator upon rotation of said rotatable element.

* * * * *